United States Patent [19]

Yirmiyahu et al.

[11] Patent Number: 4,869,465

[45] Date of Patent: Sep. 26, 1989

[54] POWER-OPERATED SPREADER TOOL

[76] Inventors: Mordechai Yirmiyahu, Ancio Sereni Street 17, Givatayim; Benyamin Yirmiyahu, Maimon Street 52, Bnei-Brak, both of Israel

[21] Appl. No.: 84,140

[22] Filed: Aug. 12, 1987

Related U.S. Application Data

[63] Continuation of Ser. No. 877,919, Jun. 24, 1986, abandoned.

[51] Int. Cl.[4] ..... B66F 3/00

[52] U.S. Cl. ..... 254/93 R

[58] Field of Search ..... 254/93 R, 104; 72/392, 72/705; 29/239

[56] References Cited

U.S. PATENT DOCUMENTS

| | | | |
|---|---|---|---|
| 1,932,584 | 10/1933 | Hansen | 72/392 |
| 2,296,173 | 9/1942 | Mandl | 72/392 |
| 2,497,836 | 2/1950 | Miller | 72/705 |
| 2,505,847 | 5/1950 | Anuszkiewicz | 254/104 |
| 2,632,238 | 3/1953 | Dyck | 29/239 |
| 3,071,887 | 1/1963 | Von Arb | 254/104 |
| 3,309,764 | 3/1967 | Klatt, Jr. | 29/239 |
| 3,819,153 | 6/1974 | Hurst et al. | 72/705 |
| 4,333,330 | 6/1982 | Porter | 72/705 |

*Primary Examiner*—Robert C. Watson

*Attorney, Agent, or Firm*—Benjamin J. Barish

[57] ABSTRACT

A spreader tool comprises a housing including a fluid cylinder, a pair of arms pivotably mounted at one end to the housing and formed with jaws at the opposite end, a piston in the fluid chamber and including a stem carrying a piston head displaceable axially between the arms, and a spring urging the pair of arms toward each other to close the jaws. One of the arms includes a rib extending along its longitudinal axis, and the other arm includes two ribs extending laterally on opposite sides of its longitudinal axis and defining a space for nesting parts of the ribs in the two arms in the fully closed position of the jaws. The ribs define track surfaces engageable by the piston head during its axial displacement between the arms for spreading apart the jaws. The piston head is of cylindrical configuration and is mounted to the piston stem so as to be rotatable about the longitudinal axis of the piston stem, thereby permitting the piston head to accommodate any uneveness in the track surfaces of the ribs.

19 Claims, 2 Drawing Sheets

POWER-OPERATED SPREADER TOOL

RELATED APPLICATION

The present application is a continuation of our Patent Application Ser. No. 06/877,919 filed June 24, 1986 now abandoned.

BACKGROUND OF THE INVENTION

The present invention relates to spreader tools, and particularly to power-operated spreader tools for applying large spreading-apart forces to an object.

Spreading tools are highly useful as rescue tools for rescuing persons from building structures that have caved in because of earthquakes, explosions, fire or like, or from automobiles that have been involved in automobile accidents. Examples of power-operated spreader tools that have been devised for this purpose are described in U.S. Pat. Nos. 4,333,330, 3,819,153 and 2,497,836.

An object of the present invention is to provide a power-operated spreader tool which is of light construction and which can be operated by a single person in order to apply spreading-apart forces of very large magnitudes to the jaws and large displacements of the jaws.

BRIEF SUMMARY OF THE INVENTION

According to the present invention, there is provided a spreader tool comprising a housing including a fluid chamber; a pair of arms pivotably mounted at one end to the housing and formed with jaws at the opposite end; a piston in the fluid chamber and including a stem carrying a piston head displaceable axially between the arms; and a spring urging the pair of arms towards each other to close the jaws. The tool further includes at least one rib projecting from the inner face of each of the arms and defining track surfaces engageable by the piston head for spreading apart the jaws. The rib of one arm is laterally spaced from the rib of the other arm to permit a part of the ribs proximate to the respective jaws to overlap each other in the fully closed condition of the jaws. Such an arrangement permits the application of large spreading-apart forces to the jaws and also large displacements of the jaws.

In the preferred embodiment of the invention described below, one arm includes one rib extending along its longitudinal axis, and the other arm includes two ribs extending laterally on opposite sides of its longitudinal axis and defining a space between the two ribs for accommodating a part of the one rib in the fully closed condition of the jaws.

According to a further feature of the invention, the piston head is of cylindrical configuration and is mounted to the piston stem so as to be rotatable about the longitudinal axis of the piston stem, thereby permitting the piston head to accommodate any uneveness in the track surfaces of the ribs. More particularly, the piston head is formed with a cylindrical socket, and the piston stem is formed with a cylindrical tip receivable in the cylindrical socket permitting rotation of the piston head with respect to the piston stem, and a retainer pin for retaining the piston head on the piston stem.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
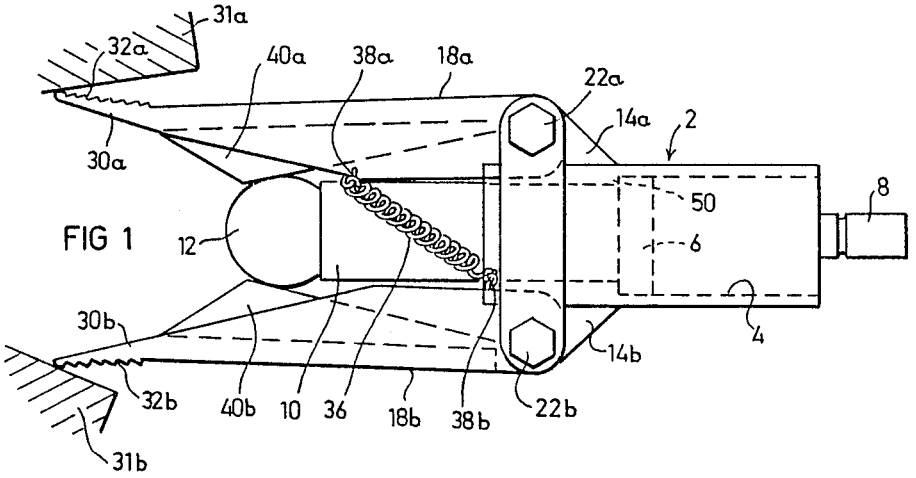
FIG. 1 is a side elevational view illustrating one form of spreader tool constructed in accordance with the present invention, the tool being shown in the jaw-opening position.

The spreader tool illustrated in the drawings comprises a housing, generally designed 2, formed with a fluid cylinder, shown by broken lines 4 in FIG. 1, receiving a piston 6 which is displaceable axially of the housing by a fluid, preferably a hydraulic liquid, applied to cylinder 4 via a fitting 8. A piston stem 10 is secured at one end to piston 6, and carries, at its opposite end, a piston head 12 of generally cylindrical configuration.

Figure 2:
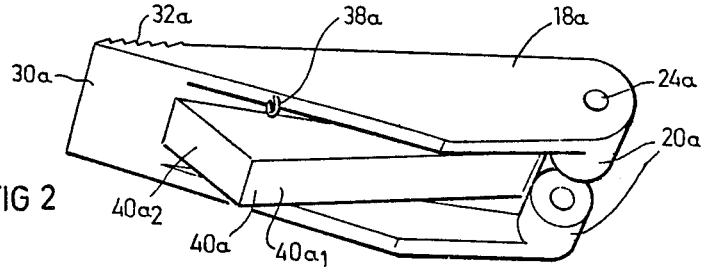
FIGS. 2 and 3 are three-dimensional views of the two jaws in tool of FIG. 1.
Figure 3:
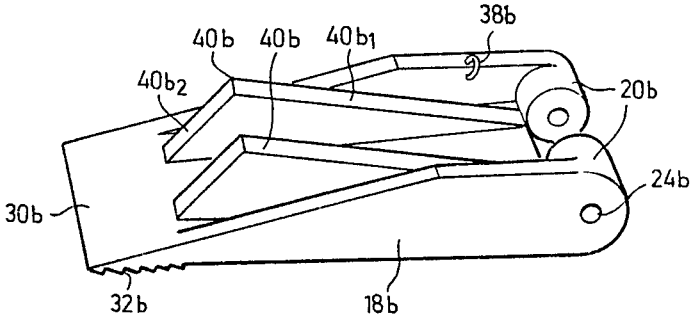
Figure 4:
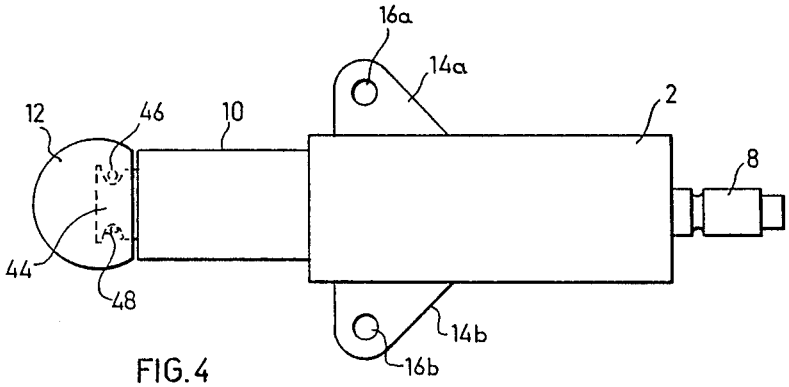
FIG. 4 is a side elevational view of the spreader tool of FIG. 1 but with the two jaws removed.
Figure 5:
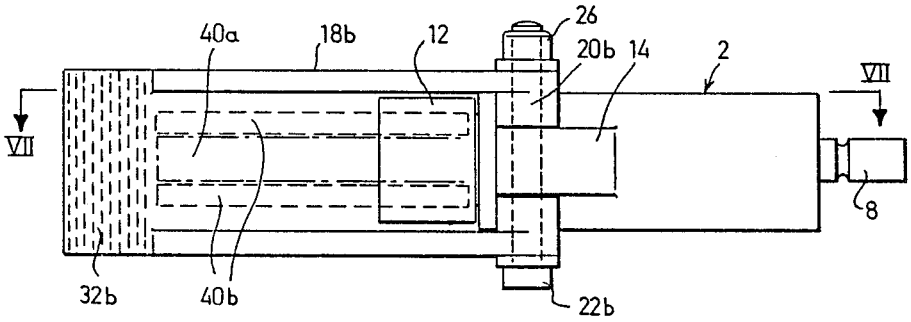
FIG. 5, is a top plan view of the spreader tool of FIG. 1.

Housing 2 includes a pair of diametrically opposed ears 14*a*, 14*b* each formed with a hole 16*a*, 16*b* pivotably mounting a pair of arms 18*a*, 18*b*. As shown particularly in FIGS. 2 and 3, each of the arms 18*a*, 18*b* is formed with a pair of trunnions 20*a*, 20*b* pivotably mounted to the ears 14*a*, 14*b* by headed pins 22*a*, 22*b* passing through openings 16*a*, 16*b* in the ears, and further openings 24*a*, 24*b* in the trunnions and secured by threaded nuts, e.g., 26, FIG. 5.

Figure 6:
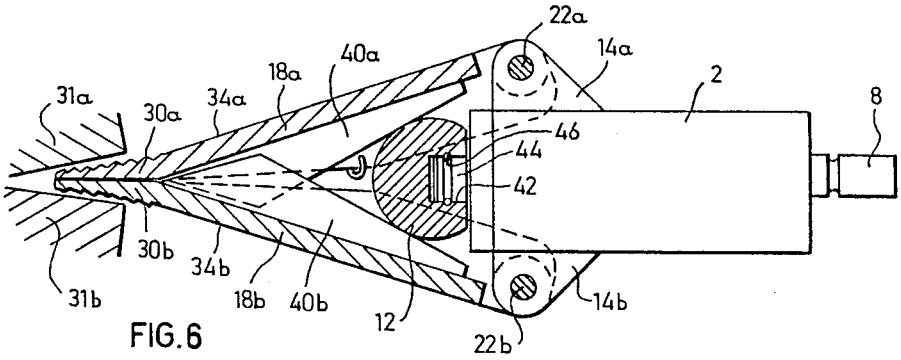
FIG. 6 a sectional view along line VI—VI of FIG. 5 with the jaws in their closed condition.

The ends 30*a*, 30*b* of the two arms 18*a*, 18*b*, opposite to their pivotable mountings to housing 2, serve as jaws which are insertable, when the jaws are closed as shown in FIG. 6, into narrow spaces in the object, or between the two objects (31*a*, 31*b* in FIGS. 1 and 6) between which the spreading-apart force is to be applied. For this purpose, the two arms, 18*a* 18*b* are of tapered configuration coming substantially to a point at the free ends of the two jaws 30*a*, 30*b*. In addition, the outer surfaces of the two jaws 30*a*, 30*b* are formed with teeth, as shown at 32*a*, 32*b*, in order to better grip the surfaces of the object 31*a*, 31*b* to which the spreading-apart forces are to be applied.

As shown particularly in FIG. 6 illustrating the closed condition of the jaws 30*a*, 30*b*, the outer surfaces, 34*a*, 34*b* of the two arms 18*a*, 18*b* define an acute angle in the closed condition of the jaws. The outer, toothed surfaces 32*a*, 32*b* of the jaws 30*a*, 30*b* are slightly offset from the remainder of the arms such that these outer surfaces of the jaws define an even smaller acute angle than surfaces 34*a*, 34*b*. This permits a substantial surface of the jaws to be received in relatively small spaces for applying the spreading-apart forces.

The two arms 18*a*, 18*b* are urged towards each other so as to close their jaws 30*a*, 30*b* by a spring 36 attached at one end to a hook 38*a* secured to the underface of arm 18*a*, and at the opposite end to a hook 38*b* secured to the underface of arm 18*b*. The two arms 18*a*, 18*b* are moved to open their respective jaws 30*a*, 30*b*, by the axial displacement of piston head 12 when its piston 6 is displaced by hydraulic fluid forced under pressure into cylinder 4 of housing 2.

For purposes of forcing the jaws apart, the inner confronting faces of the two arms 18*a*, 18*b* are formed with ribs 40*a*, 40*b* engageable by piston head 12. As shown particularly in FIGS. 2 and 3, respectively, arm 18*a* is formed with one rib 40*a* extending along the longitudinal axis of the arm; whereas arm 18*b* is formed with two ribs 40*b* both extending axially of the arm but spaced laterally on opposite sides of its longitudinal axis by a space slightly greater than the thickness of rib 40*a* of arm 18*a*, so as to accommodate rib 40*a* in the closed condition of the jaws 30*a*, 30*b*.

Ribs 40*a*, 40*b* are both of triangular shape. Each includes a rear section $40a_1$, $40b_1$, distal from the respective jaws 30*a*, 30*b*, and having a straight, flat outer surface which is engageable by the cylindrical piston head 12. Each rib 40*a*, 40*b* further includes a front section $40a_2$, $40b_2$, proximal to the respective jaw 30*a*, 30*b*, and having an outer surface which is substantially at a right angle to the flat outer surface of the rib rear sections $40a_1$, $40b_1$.

As will be described more particularly below, the rib rear sections $40a_1$, $40b_1$ define tracks engageable by the cylindrical piston head 12 during its axial displacement towards the jaws 30*a*, 30*b* for forcing the jaws apart to their open positions as illustrated in FIG. 1; whereas the front rib section $40a_2$ of arm 18*a* overlaps and nests between the front sections $40b_2$ of the two ribs 40*b* formed in arm 18*b* in the closed condition of the jaws as shown particularly in FIG. 6. This construction of the ribs 40*a*, 40*b* strengthens the arms against large forces, and also permits a larger displacement of the cylindrical piston head 12 from the closed positions of the jaws (FIGS. 5 and 6) to their open positions (FIG. 1), and thereby a larger opening movement of the jaws.

The cylindrical piston head 12 is mounted to piston stem 10 in a manner permitting rotary movement of the piston head about the longitudinal axis of the piston stem. For this purpose, the cylindrical piston head 12 is formed with a cylindrical socket 42, and piston stem 10 is formed with a cylindrical tip 44 received within socket 42 and locked within the socket by a locking pin 46 seated in an annular groove 48. This mounting of the cylindrical piston head 12, for rotary movement about the longitudinal axis of stem 10, permits the piston head to accommodate itself with respect to any uneveness in the track surfaces $40a_1$, $40b_1$, of the two arms 18*a*, 18*b*.

The operation of the illustrated spreader tool will be apparent from the above description. In its normal condition, cylinder 4 in housing 2 is not subjected to pressurized liquid, so that spring 36 urges the two arms 18*a*, 18*b* to the closed condition of the jaws 30*a*, 30*b*, as shown in FIG. 6, thereby forcing piston head 12 to its retracted position within housing 2. In this closed condition of the jaws, the nesting of the front section $40a_2$ of rib 40*a*, formed on the inner face of arm 18*a*, in the space between the front sections $40b_2$ of the two ribs 40*b*, formed in the inner face of arm 18*b*, permits the jaws 30*a*, 30*b* to be completely closed so as to form a relatively small acute angle between their outer toothed surfaces 32*a*, 32*b*, thereby enabling the jaws to be inserted into a relatively small space between the surfaces 31*a*, 31*b* against which the spreading-apart force is to be applied.

When a spreading-apart force is to be applied, hydraulic liquid is introduced via fitting 8 into cylinder 4 of the housing 2, to displace piston 6 towards jaws 30*a*, 30*b*. The cylindrical piston head 12 carried by the piston stem 10 is thereby displaced outwardly and moves along the inclined track surfaces $40a_1$, $40b_1$, of the ribs 40*a*, 40*b* formed on the confronting faces of the two arms 18*a*, 18*b* to force the two arms apart and to thereby drive the jaws 30*a*, 30*b* to their open positions as illustrated in FIG. 1. As known in hydraulic jacks of this type, the hydraulic fluid may be pumped by a manual pump, similar to a manually operated hydraulic jack, and the cylinder 4 within housing 2 may include a stop, schematically indicated at 50 (FIG. 1) for limiting the outward displacement of piston 6, and thereby of the piston head 12.

As described earlier, the construction of the ribs permitting rib 40*a* of arm 18*a* to nest between the two ribs 40*b* of arm 18*b*, provides a large length of travel of the piston head 12 when moving towards the fully open position, thereby increasing the magnitude of displacement of the jaws 30*a*, 30*b*; whereas the ribs also strengthen the arms thereby permitting larger forces to be applied to their jaws. In addition, the rotatable mounting of the cylindrical piston head 12 to its piston stem 10 permits the piston head to accommodate itself to any uneveness or non-alignment with respect to the track surfaces $40a_1$, $40b_1$ formed on the ribs 40*a*, 40*b* of the two arms.

After the spreader tool has been operated to spread apart the surface 31*a*, 31*b* of the object to the maximum position permitted by the tool, it may be necessary or desirable to spread these surfaces even further apart. This may be done in the following manner: A block, jack, or other device may be applied between the spread-apart jaws 30*a*, 30*b* to maintain them in their fully open position as illustrated in FIG. 1; piston 6 may then be retracted into housing 2; a larger diameter piston head 12 may be substituted for the one previously used; and the tool may be again actuated to move the larger-diameter piston head 12 towards jaws 30*a*, 30*b*, whereupon the piston head will again ride on the track surfaces of ribs $40a_1$, $40b_1$, to further spread apart the jaws.

A tool spreader was constructed according to the structure illustrated in the drawings, weighing under 10 Kg, and having a spreading power of about 4,000 Kg with closed jaws (FIG. 6), and about 7,500 Kg as the jaws approached their fully open position (FIG. 1).

While the invention has been described with respect to one preferred embodiment, it will be appreciated that many other variations, modifications and applications of the invention may be made.

What is claimed is:

1. A spreader tool, comprising:

a housing including a fluid chamber;

a pair of arms pivotably mounted at one end to said housing and formed with jaws at the opposite end;

a piston in said fluid chamber and including a stem carrying a piston head displaceable axially between said arms;

a spring urging said pair of arms towards each other to close said jaws;

and at least one rib projecting from the inner face of each of said arms, which ribs define track surfaces engageable by the piston head for spreading apart said jaws;

the rib of one arm being laterally spaced from the rib of the other arm to permit a part of the ribs to overlap each other in the fully closed condition of the jaws.

2. The spreader tool according to claim 1, wherein one of said arms includes one rib extending along its longitudinal axis, and the other of said arms includes two ribs extending laterally on opposite sides of its longitudinal axis and defining a space between said two ribs for accommodating a part of said one rib in the fully closed condition of the jaws.

3. The spreader tool according to claim 1, wherein said tracks are constituted of straight flat surfaces formed on said ribs.

4. The spreader tool according to claim 1, wherein each of said ribs is of triangular shape, said ribs including straight rear sections distal from the jaws and having flat outer surfaces, constituting said track surfaces, converging in the direction of the jaws, and front sections proximal to the jaws and having outer surfaces diverging in the direction of the jaws, said front sections of the ribs being in nesting relationship to each other in the fully closed condition of the jaws.

5. The spreader tool according to claim 1, wherein said piston head is of cylindrical configuration and is mounted to the piston stem so as to be rotatable about the longitudinal axis of the piston stem, thereby permitting the piston head to accommodate any uneveness in the track surfaces of the ribs.

6. The spreader tool according to claim 5, wherein said piston head is formed with a cylindrical socket, and said piston stem is formed with a cylindrical tip receivable in said cylindrical socket permitting rotation of the piston head with respect to the piston stem, and a retainer pin for retaining the piston head on the piston stem.

7. The spreader tool according to claim 1, wherein the outer surfaces of said arms define an acute angle in the closed condition of the jaws; the jaws being slightly offset from the remainder of the arms such that the outer surfaces of the jaws define a smaller acute angle than that of the outer surfaces of the arms in the closed condition of the jaws.

8. The spreader tool according to claim 7, wherein the outer surfaces of the jaws are formed with teeth.

9. A spreader tool comprising:

a housing including a fluid cylinder;

a pair of arms pivotably mounted at one end to said housing and formed with jaws at the opposite end;

a piston in said fluid chamber and including a stem carrying a piston head displaceable axially between said arms;

and a spring urging said pair of arms towards each other to close said jaws;

one of said arms including a rib extending along its longitudinal axis, and the other of said arms including two ribs extending laterally on opposite sides of its longitudinal axis and defining a space between said two ribs for accommodating a part of said one rib in the fully closed position of the jaws, said ribs defining track surfaces engageable by the piston head during its axial displacement between the arms for spreading apart the jaws.

10. The spreader tool according to claim 9, wherein said tracks are constituted of straight flat surfaces formed on said ribs.

11. The spreader tool according to claim 9, wherein each of said ribs is of triangular shape, said ribs including straight rear sections distal from the jaws and having flat outer surfaces, constituting said track surfaces, converging in the direction of the jaws, and front sections proximal to the jaws and having outer surfaces diverging in the direction of the jaws, said front sections of the ribs being in nesting relationship to each other in the fully closed condition of the jaws.

12. The spreader tool according to Claim 9, wherein said piston head is of cylindrical configuration and is mounted to the piston stem so as to be rotatable about the longitudinal axis of the piston stem, thereby permitting the piston head to accommodate any uneveness in the track surfaces of the ribs.

13. The spreader tool according to Claim 9, wherein said piston head is formed with a cylindrical socket, and said piston stem is formed with a cylindrical tip receivable in said cylindrical socket permitting rotation of the piston head with respect to the piston stem, and a retainer pin for retaining the piston head on the piston stem.

14. A spreader tool comprising;

a housing including a fluid cylinder;

a pair of arms pivotably mounted at one end to said housing and formed with jaws at the opposite end;

a piston in said fluid chamber and including a stem carrying a piston head displaceable axially between said arms and engageable with the inner confronting faces thereof for spreading apart said jaws when the piston head is movable towards said jaws;

and a spring urging said pair of arms towards each other to close said jaws;

said piston head being of cylindrical configuration and mounted to the piston stem so as to be rotatable about the longitudinal axis of the piston stem, thereby permitting the piston head to accommodate itself with respect to any uneveness in the inner confronting surfaces of said arms.

15. The spreader tool according to claim 14, wherein said piston head is formed with a cylindrical socket, and said piston stem is formed with a cylindrical tip receivable in said cylindrical socket permitting rotation of the piston head with respect to the piston stem, and a retainer pin for retaining the piston head on the piston stem.

16. The spreader tool according to claim 14, wherein each of the confronting surfaces of said arms include at least one rib projecting towards the confronting surface of the other arm, which ribs are formed with track surfaces engageable by the piston head during its axial movement towards the jaws for spreading apart said jaws, the rib of one arm being laterally spaced from the rib of the other arm to permit the sections of the ribs proximate to their respective jaws to overlap each other in the fully closed position of the jaws.

17. The spreader tool according to claim 16, wherein one of said arms includes one rib extending along its longitudinal axis, and the other of said arms includes two ribs extending laterally on opposite sides of its longitudinal axis and defining a space between said two ribs for accommodating a part of said one rib in the fully closed condition of the jaws.

18. The spreader tool according to claim 16, wherein said tracks are constituted of straight flat surfaces formed on said ribs.

19. The spreader tool according to claim 16, wherein each of said ribs is of triangular shape, said ribs including straight rear sections distal from the jaws and having flat outer surfaces, constituting said track surfaces, converging in the direction of the jaws, and front sections proximal to the jaws and having outer surfaces diverging in the direction of the jaws, said front sections of the ribs being in nesting relationship to each other in the fully closed condition of the jaws.

* * * * *